US005884597A

United States Patent [19]

Hiraku et al.

[11] Patent Number: 5,884,597

[45] Date of Patent: Mar. 23, 1999

[54] FUEL FEEDING APPARATUS FOR INTERNAL COMBUSTION ENGINE AND VEHICLE USING THE FUEL FEEDING APPARATUS

[75] Inventors: Kenji Hiraku, Niihari-gun; Tadahiko Nogami, Mito; Kenji Okuna; Kiyoshi Amou, both of Niihari-gun; Atsuji Saito; Atsuo Kishi, both of Hitachinaka, all of Japan

[73] Assignee: Hitachi, Ltd., Tokyo, Japan

[21] Appl. No.: 879,610

[22] Filed: Jun. 20, 1997

[30] Foreign Application Priority Data

Jun. 20, 1996 [JP] Japan ..... 8-159664

[51] Int. Cl.[6] ..... F02N 17/00

[52] U.S. Cl. ..... 123/179.17; 123/447

[58] Field of Search ..... 123/446, 447, 123/510, 511, 179.17, 179.7, 179.9, 305

[56] References Cited

U.S. PATENT DOCUMENTS

| | | | |
|---|---|---|---|
| 4,667,638 | 5/1987 | Igashira et al. | 123/179.17 |
| 4,867,115 | 9/1989 | Henein | 123/179.17 |
| 5,513,614 | 5/1996 | Gras et al. | 123/179.17 |
| 5,546,912 | 8/1996 | Yamada et al. | 123/511 |

FOREIGN PATENT DOCUMENTS

| | | |
|---|---|---|
| 5-321787 | 12/1993 | Japan . |
| 7-158536 | 6/1995 | Japan . |
| 8-28335 | 1/1996 | Japan . |

*Primary Examiner*—Thomas N. Moulis
*Attorney, Agent, or Firm*—Antonelli, Terry, Stout & Kraus, LLP

[57] ABSTRACT

A fuel feeding apparatus includes a pressure increasing piston system, in addition to a high pressure fuel pump, for further increasing the fuel pressure at the outlet of the high pressure fuel pump. For this purpose, a first piston provided in a first cylinder is moved in response to the pressure of fuel drawn up from a fuel tank and fed to the high pressure pump by a low pressure fuel feed pump, and a second piston provided in a second cylinder and having a diameter smaller than the diameter of the first piston is connected to the first piston and is moved together with the first piston for pressurizing fuel in the second cylinder communicating with the outlet of the high pressure fuel pump at the time of engine starting, and before the high pressure fuel pump is started. The first and second pistons then are automatically returned to their initial positions, respectively, after high pressure fuel pump is started, while the pressure of the highly pressurized fuel in the high pressure fuel pipe is maintained by a high pressure regulator, by designing the first and second cylinders, including the relative sizes of the respective pistons, so that a possible maximum pressure to which the fuel is increased by the piston system is set to a value lower than a preset high pressure value to be attained by the high pressure fuel pump.

14 Claims, 7 Drawing Sheets

FP : LOW PRESSURE FUEL FEED PUMP

HP : HIGH PRESSURE FUEL PUMP

FUEL FEEDING APPARATUS FOR INTERNAL COMBUSTION ENGINE AND VEHICLE USING THE FUEL FEEDING APPARATUS

BACKGROUND OF THE INVENTION

The present invention relates to a fuel feeding apparatus for an internal combustion engine and a vehicle using the fuel feeding apparatus, and especially, the invention relates to a fuel feeding apparatus which is effective to improve the characteristics of engine starting and to realize a stable fuel injection.

A fuel feeding apparatus for directly injecting fuel in cylinders of an internal combustion engine, typically referred to as a direct injection type fuel feeding apparatus, is able to feed an accurate amount of fuel to the cylinders of the engine, and has proven to be an effective means to improve the characteristics of engine starting. For a diesel engine, a direct injection type fuel feeding apparatus has been dominantly used, and also for a gasoline engine, the use of a direct injection type fuel feeding apparatus in place of an air-intake pipe injection type fuel feeding apparatus is becoming more common. Further, in an internal combustion engine using a direct injection type fuel feeding apparatus, the pressure of the fuel injection tends to further increase. The pressure of fuel injection in a direct injection gasoline engine is about 5–10 MPa, higher by 15 times than the pressure of fuel injection in an air-intake pipe injection type internal combustion engine. The requirement of a high pressure for a direct injection gasoline engine causes a problem in that the time necessary to increase the pressure of fuel injection to a preset high pressure value becomes elongated, which degrades the characteristics of engine starting.

To solve this problem, in a fuel feeding apparatus disclosed in JP-A-321787/1993, an auxiliary pump used exclusively to increase the fuel pressure at the time of engine starting is provided in addition to the ordinary high pressure fuel pump for pressurizing fuel to a high pressure value, which is continuously operated during operation of the internal combustion engine. The auxiliary pump is driven by fuel of low pressure, which is fed from a fuel feed pump, and serves to supplement the pressure which is increasing in a high pressure fuel system at the time of engine starting. After the engine has stopped, the operational state of the auxiliary pump is returned to its initial state, and the pressure of the fuel in the high pressure fuel system is decreased.

A fuel feeding apparatus for a direct injection gasoline engine is disclosed, for example, in JP-A-158536/1995 or JP-A-28335/1996. The fuel feeding apparatus disclosed in each of these documents comprises a low pressure fuel feed pump for pressurizing fuel to a low pressure and transferring the fuel of low pressure, a high pressure fuel pump, a low pressure regulator and a high pressure regulator for regulating the discharge pressure of each pump, fuel injection valves provided at respective cylinders of an engine, and fuel pipes connecting the above-mentioned components. In the following, the operations of these components will be explained.

The low pressure fuel feed pump is installed at or in the vicinity of a fuel tank provided at the back part of a vehicle, and this pump feeds gasoline in the tank to the engine compartment provided at the front part of the vehicle. The gasoline to be fed is first pressurized to about 0.3 MPa as controlled by the low pressure regulator. The high pressure fuel pump further pressurizes the gasoline of low pressure fed by the low pressure fuel feed pump to a high pressure and feeds it to the injection valves. The high pressure regulator regulates the pressure of the high pressure gasoline so as to keep a preset pressure value of 5–10 MPa. Then, each of the injection valves atomizes the high pressure gasoline, and directly injects the atomized gasoline into the respective engine cylinders.

Further, in a high pressure fuel pipe system, a means for removing vapor bubbles generated in the gasoline needs to be provided. That is, by providing the high pressure fuel pump at the beginning of the high pressure fuel pipe system and the high pressure regulator at the end of the high pressure fuel pipe system, gasoline including vapor bubbles generated in the fuel contained in the high pressure fuel pipe system is circulated between the high pressure fuel pump and the high pressure regulator, and the generated vapor bubbles are ejected from the gasoline by the high pressure regulator.

It is desirable to reduce the time necessary to increase the pressure of the fuel in a high pressure fuel system of a fuel feeding apparatus for a direct injection internal combustion engine to a preset high pressure value at the time of engine starting.

In the fuel feeding apparatus disclosed in JP-A-321787/1993, the time necessary to increase the pressure of the fuel in a high pressure fuel system (referred to as the fuel pressure increasing time) is reduced by the auxiliary pump provided for improving the engine starting. However, since the operational state of the auxiliary pump is returned to its initial state after engine is stopped, and the pressure of the high pressure fuel system is decreased, the process of increasing the pressure of the fuel in the high pressure fuel system from a low pressure state must be repeated every time the engine is started. Therefore, it is difficult to largely and efficiently reduce the fuel pressure increasing time by using the above-mentioned auxiliary pump.

Further, in order to improve the safety of the high pressure fuel system, it is desirable to reduce the length of each pipe set up in the high pressure fuel system by providing the high pressure regulator at a place as near as possible to the high pressure fuel pump, in each of which fluid of high pressure is processed. As mentioned above, since a method of circulating fuel between the high pressure fuel pump and the high pressure regulator is adopted to remove vapor bubbles in the gasoline in the conventional fuel feeding apparatus, the fuel feeding apparatus is arranged such that-the high pressure fuel pump is provided at the beginning of the high pressure fuel system and the high pressure regulator is provided at the end of the high pressure fuel system. Therefore, when the high pressure fuel pump and the high pressure regulator are installed near each other, the high pressure fuel pipe, in which the high pressure fuel flows and to which the injection valves are connected in order, is extended from the high pressure pump and is bent after the last injection valve. Further, the fuel-pipe is bent and connected to the high pressure regulator provided near to the high pressure fuel pump. In the above mentioned arrangement of the fuel feeding apparatus, the high pressure fuel pipe becomes undesirably long.

If the fuel pipe is long, it can cause an unstable performance problem in engine operations. That is, first the pressure of the fuel in the high pressure fuel pipe is decreased due to fuel injection from each injection valve, and then the pressure is adjusted and returned to the preset value by the high pressure regulator. Cycling of this decrease and increase in the pressure of the fuel in the high pressure fuel pipe is repeated. Due to this repeated cycling of the pressure of the fuel, the liquid fuel column in the high pressure fuel pipe is excited and oscillated. Since the period of fuel injection performed by the injection valves changes according to the engine speed, the frequency of the oscillating liquid fuel column also changes. If the characteristic frequency of the liquid fuel column in the high pressure fuel pipe is low, it is possible that the frequency of the excited oscillation at an ordinarily operating engine speed will coincide with the characteristic frequency of the liquid fuel column, so that a resonance phenomenon will be generated in the high pressure fuel pipe. In such a case, a large pulsation of the fuel pressure is caused, and the large pressure pulsation makes it impossible to accurately control the amount of fuel to be injected, which largely deteriorates the operational performance of the internal combustion engine.

SUMMARY OF THE INVENTION

It is a first object of the present invention to improve the operational characteristics of engine starting by reducing the time necessary to increase the pressure of fuel to be fed to an internal combustion engine, at the time of engine starting, to a preset high pressure value.

It is a second object of the present invention to provide a fuel feeding apparatus which is able to stably and accurately control the amount of fuel to be injected, by preventing resonance pressure pulsation in a high pressure fuel pipe which may be caused by fuel injections from the injection valves, in addition to improving the operational characteristics of engine starting, by increasing the speed of fuel pressurizing.

It is a third object of the present invention to provide a vehicle having a structure suitable for using the above-mentioned fuel feeding apparatus.

To attain the first object, the present invention provides a fuel feeding apparatus for an internal combustion engine, which comprises:

a low pressure fuel feed pump for pressurizing and transferring fuel from a fuel tank;

a high pressure fuel pump for more highly pressurizing the fuel transferred by the low pressure fuel feed pump and for feeding the more highly pressurized fuel to a high pressure fuel pipe system;

a pressure increasing means, provided in addition to the high pressure fuel pump, for increasing the pressure of the fuel being fed in the high pressure fuel pipe system at the time of engine starting, and for returning the operational state of the pressure increasing means to an initial state, while a preset high pressure value attained by the high pressure fuel pump is maintained, after the engine is stopped subsequently to starting; and injection valves for injecting the fuel pressurized to the preset high pressure value, being fed by the high pressure fuel pipe system, into cylinders of the internal combustion engine.

Further, in the above-mentioned fuel feeding apparatus, the pressure increasing means includes a pressure increasing cylinder comprising a first piston moving in response to the pressure of the fuel fed by the low pressure fuel feed pump, and a second piston of a diameter larger than the diameter of the first piston, connected to the first piston and moved together with the first piston, for pressurizing fuel in the high pressure fuel pipe system.

Further, in the above-mentioned fuel feeding apparatus, the positions of the two-pistons are automatically returned to initial positions of the two pistons, respectively, by forming the pressure cylinder comprising the two pistons so that a possible maximum pressure increased by the two pistons is lower then the preset high pressure value to be attained by the high pressure fuel pump, while the preset high pressure value attained by the high pressure fuel pump is substantially maintained, after the engine is stopped.

Further, in the above-mentioned fuel feeding apparatus, an accumulator is connected to the high pressure fuel pipe system, and a preset accumulation start pressure value used for starting fuel accumulation, when the pressure of the fuel in the high pressure fuel pipe system exceeds the preset accumulation start pressure value, is set higher than the possible maximum pressure to be attained by the pressure increasing means.

To attain the second object of the present invention, in the above-mentioned fuel feeding apparatus, the high pressure fuel system has a closed end mechanism, and a high pressure regulating means for adjusting the pressure of fuel in the high pressure fuel pipe system, so as to maintain the preset high pressure value, is provided between the high pressure fuel pump and the injection valves, whereby generation of vapor bubbles in the fuel is prevented, and a resonance oscillation of the liquid column of fuel in the high pressure fuel pipe system is also prevented by using a shortened pipe in the high pressure fuel pipe system.

To attain the third object of the present invention a vehicle is provided, comprising:

a fuel tank provided at a back part of a body of the vehicle;

a low pressure fuel feed pump in the vicinity of the fuel tank;

an internal combustion engine, provided at front part of the body of the vehicle, including injection valves for injecting fuel into cylinders of the cylinder;

a high pressure fuel pump provided in the vicinity of the internal combustion engine, for more highly pressurizing the fuel fed from the fuel tank by the low pressure fuel feed pump through a low pressure fuel pipe;

a high pressure fuel pipe system from which the fuel more highly pressurized by the high pressure fuel pump is fed to each of the injection valves; and pressure increasing means provided in the vicinity of the high pressure fuel pump, including a fuel pressurizing cylinder for pressurizing fuel in the high pressure fuel pipe system, and pistons in the cylinder being driven and moved by the pressure of the fuel fed from the low pressure fuel feed pump at the time of engine starting, the pistons being reversely driven and returned to the initial positions of the pistons by the pressure of the fuel of high pressure, pressurized by the high pressure fuel pump, when the pressure of the fuel of high pressure exceeds a preset value.

DETAILED DESCRIPTION OF THE EMBODIMENTS

Figure 1:
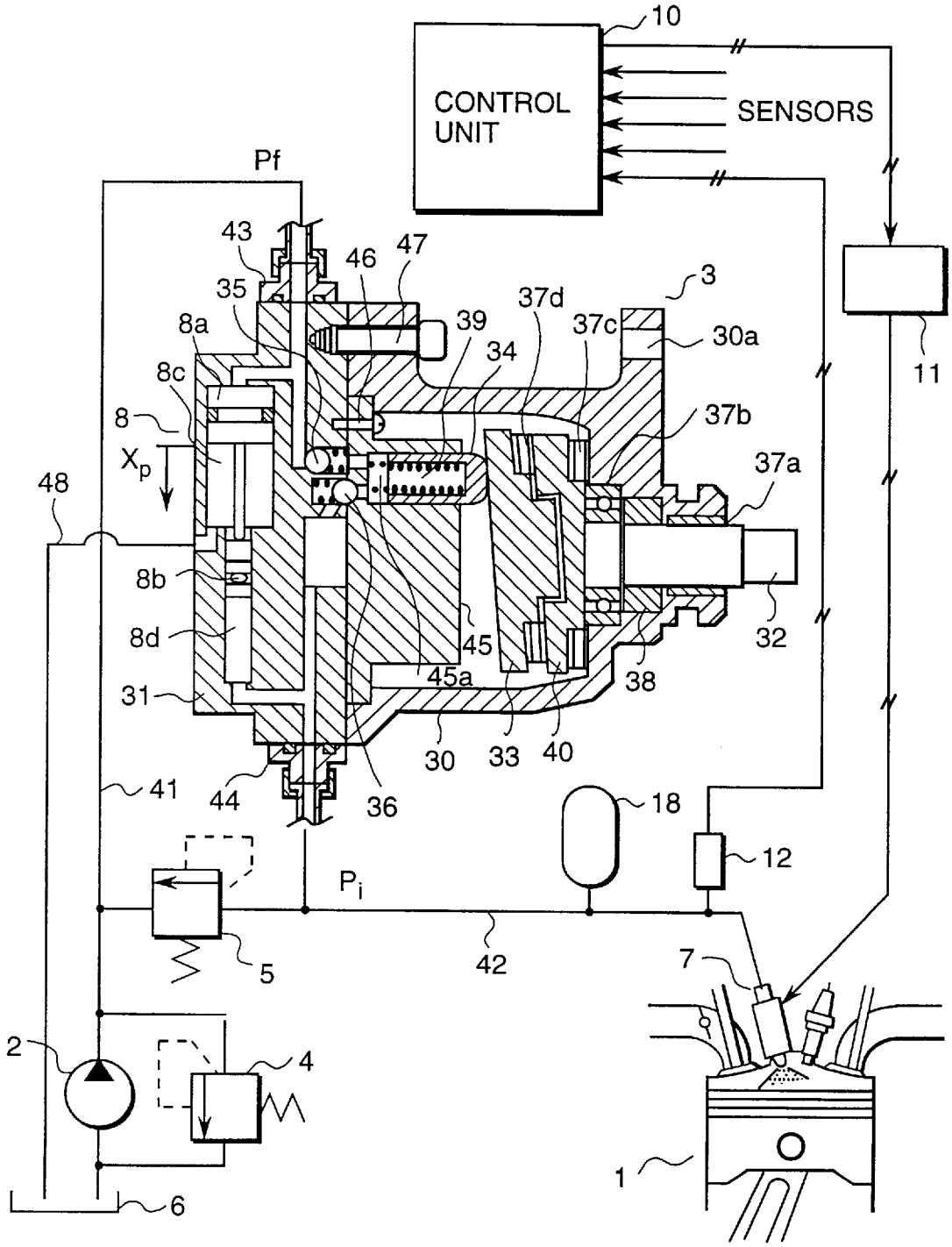
FIG. 1 is a diagram of a fuel system of a fuel feeding apparatus forming an embodiment according to the present invention.

Hereinafter, details of the present invention will be explained with reference to the embodiments shown in the drawings.

By referring to FIG. 1 and FIGS. 2A–2C, the fundamental composition and the operational characteristics, at the time of engine starting, of an fuel feeding apparatus according to the present invention, will be explained in the following, as compared with the operational characteristics of a conventional fuel feeding apparatus in which an auxiliary pump (intensifier) for engine starting is not used.

FIG. 1 shows a fuel system of the fuel feeding apparatus for an internal combustion engine (gasoline engine) representing an embodiment according to the present invention, in which a high pressure fuel pump and an intensifier are shown in longitudinal section. The fuel feeding apparatus comprises a low pressure fuel feed pump 2 for pressurizing fuel stored in a fuel tank 6 to a preset low pressure value and the transferring the pressurized fuel vie a low pressure fuel pipe 41; a low pressure regulator 4 for adjusting the pressure of the fuel discharged from the low pressure fuel feed pump 2 to maintain the preset low pressure value; a high pressure fuel pump 3 for further more highly pressurizing the fuel discharged from the low pressure fuel feed pump 2; a high pressure regulator 5 for adjusting the pressure of fuel in a high pressure fuel pipe 42, discharged from the high pressure fuel pump 3, to maintain a preset high pressure value, which is considerably higher than the preset low pressure value; injection valves 7 for injecting the highly pressurized fuel in the high pressure fuel pipe 42 into cylinders in an engine block 1 (internal combustion engine); an intensifier 8 connected to the high pressure fuel pump 3, the fuel exit of which communicates with a fuel flow path between the low pressure fuel pipe 41 and the high pressure fuel pipe 42; an accumulator 18 connected to the high pressure fuel pipe 42 at the discharge side of the high pressure fuel pump 3; an injection valve driving circuit 11 for controlling a driving current fed to each of the injection valves 7; a pressure sensor 12 for detecting the pressure of the highly pressurized fuel (referred to as high pressure fuel) to be fed to the injection valves 7; and a control unit 10 for sending control signals to the injection valve driving circuit 11, based on operational information obtained from various sensors for detecting various operational states of the vehicle.

Further, the high pressure fuel pump 3 is an axial cam plate type piston pump, which is composed of a shaft 32 rotationally driven by a driver (not shown in the figure); an oil seal 38 for preventing the leakage of fluid in the pump 3; a cam plate 40 for conversing rotational motion to oscillating motion; an oscillating plate 33 driven by the cam plate 40 for performing an oscillatory motion; bearings 37*a*–37*d* for supporting the above-mentioned parts; pistons 34 provided at pistons 45*a* circularly arranged at a cylinder body 45, pressed by the oscillating plate 33 and performing a reciprocating motion; springs 39, each of which presses each of the pistons 34 toward the oscillating plate 33; pairs of intake check valves 35 and discharge check valves 36, each pair functioning for taking in and discharging fuel, according to the reciprocating motion of the piston 34; a casing 30; and a rear body 31. Although a piston pump is used in this embodiment, any type pump, for example, a gear type pump or a vane type pump, can be used for the high pressure fuel pump of the feeding apparatus according to the present invention.

The intensifier 8 comprises a piston 8*a* of large diameter and a piston 8*b* of small diameter, and a cylinder 8*c* of large diameter and a cylinder 8*d* of small diameter, which contain the pistons 8*a* and 8*b*, respectively, and make it possible for the respective pistons 8*a* and 8*b* to move in the axial direction. The pressure of fuel is increased in accordance with Pascal principle by the intensifier 8. The force balance equation in the intensifier 8 is expressed as $P1 \times A1 = P2 \times A2$, according to Pascal principle, where A1: a pressure receiving area of the piston 8*a* of large diameter (referred to as the large diameter piston 8*a*), A2: a pressure receiving area of the piston 8*b* of small diameter(referred to as the small diameter piston 8*b*), P1: the pressure applied to a pressure receiving face of the large diameter piston 8*a*, and P2: the pressure applied to a pressure receiving face of the small diameter piston 8*b*. From the above-described equation, it is known that when the pressure P1 is applied to the large diameter piston 8*a*, the pressure in the cylinder 8*d* is increased to the pressure $P2(=P1 \times (A1/A2))$, where (A1/A2) is called an intensification ratio (a pressure increase ratio).

In this embodiment the high pressure fuel pump 3 and the intensifier 8 are integrated into one body. The cylinder body 45 is connected to the rear body 31 with a connection screw 46, and fuel paths in the rear body 31 communicate with a fuel flow path at the outlet of the high pressure fuel pump 3, which communicates with the high pressure fuel pipe 42. The rear body 31 includes the intensifier 8; a low pressure fuel pipe joint 43, which connects the low pressure fuel pipe 41 to the rear body 31 and is mounted at a common entrance where the fuel path is split into a fuel flow path leading to the intake check valves 35 and a fuel flow path leading to the large diameter cylinder 8*c*; and a high pressure fuel pipe joint 44 connecting the high pressure pipe 42 to the rear body 31, which is mounted at a common exit, where the of fuel flow paths from the discharge check valves 36 and from the exit of the small diameter cylinder 8*d* are connected in common. Further, the casing 30 and the rear body 31 are connected to each other with a connection screw 47 so as to be integrated into one body. Furthermore, the casing 30 and the rear body 31, integrated into one structure, are connected to the engine block 1 by using a screw hole 30*a* formed in the casing 30.

Although a unitary body structure in which the intensifier 8 is connected to the high pressure fuel pump 3 has been adopted, it is naturally possible to obtain the same pressure increasing function as the function of one body structure, by adopting an arrangement in which the intensifier 8 is separated from the high pressure fuel pump 3, or an arrangement in which the intensifier 8 is connected to the high pressure fuel pump 3 with a pipe.

The low pressure fuel feed pump 2, generally driven by a motor using electrical energy, is installed at or in the vicinity of the fuel tank 6 provided at the back of a vehicle. The fuel of low pressure (Pf) discharged from the low pressure fuel pump 2 to the low pressure fuel pipe 41 is adjusted so as to maintain a preset low pressure value of about 0.3 MPa, using the low pressure regulator 4, so as to be fed to the high pressure fuel pump 3. Further, the high pressure fuel pump 3 more highly pressurizes the low pressure fuel, so that fuel highly pressurized by the high pressure fuel pump 3 (referred to as high pressure fuel) is fed to the injection valves 7 connected to the high pressure fuel pipe 42. The pressure Pi of the high pressure fuel is adjusted so as to maintain a preset high pressure value of 5–10 MPa, using the high pressure regulator 5. The high pressure fuel pump 3 is driven by a motor or the rotational force transmitted from the internal combustion engine. In the case of a gasoline engine, the high pressure fuel pump 3 is, directly or via a pulley, connected to a cam shaft of the engine.

In the following, changes in the fuel pressure at the time of engine starting will be explained with reference to FIGS. 2A–2C, assuming that the fuel feeding apparatus does not have the accumulator 18 shown in FIG. 1, for the simplicity of explanation. In the case to be explained, the low pressure fuel feed pump 2 and the high pressure fuel pump 3 are driven by a motor and the engine, respectively. Further, in FIGS. 2A–2C, the operational characteristics of the fuel feeding apparatus according to the present invention are compared with the operational characteristics of a conventional fuel feeding apparatus.

At first, an explanation will be given concerning the operational characteristics of a conventional fuel feeding apparatus, that is, an apparatus without an auxiliary fuel pressure increasing component, such as the intensifier 8, as used in the fuel feeding apparatus according to the present invention.

Under the assumption that the fuel feed pressure Pf (the pressure of fuel in the low pressure fuel pipe 41) and the fuel injection pressure Pi (the pressure of fuel in the high pressure fuel pipe 42) both are 0 in the initial state, at first, when the ignition key is turned to the position "ON" at the time T1, the low pressure fuel feed pump 2 is driven, and the fuel feed pressure Pf is immediately increased to the preset low pressure value P1. In a conventional fuel feeding apparatus, since fuel in the high pressure fuel pipe is not pressurized until the high pressure fuel pump is driven, the pressure Pi of fuel injection remains 0. When the position of the ignition key is turned to the position "START" of engine starting at the time T2, the high pressure fuel pump directly connected to the engine starts, and the pressure Pi of fuel injection begins to increase as indicated by an alternate long and short dash line in FIGS. 2A–2C. After the pressure Pi reaches a preset high pressure value Pset, the pressure Pi is adjusted so as to maintain the preset high pressure value Pset, using a high pressure regulator. To improve the operational characteristics of engine starting, it is important to increase the pressure Pi to Pset in a short period from the time T1. Moreover, if the fuel injection can be started at a sufficiently high pressure state from the engine starting, since the operational characteristics of engine starting are improved by the progressive atomization of fuel, the amount of hydrocarbon HC in the exhaust gas and the load applied to the starter or the battery can be reduced.

One method of shortening the time for increasing the pressure of fuel is to inject much fuel into the high pressure fuel pipe in a short period by increasing the flow rate of fuel discharged by a high pressure fuel pump. However, in a high pressure fuel pump driven by an engine, the fuel flow rate of the high pressure fuel pump is small as a matter of course since the rotational speed of the pump is low at engine starting. Although the fuel flow rate can be increased at a low rotational speed by increasing the displaced volume (referred to as a displacement) per rotation of the pump, the performance of fuel consumption is degraded due to the increase in the engine load during ordinary running operations. In order to increase the fuel flow rate of the pump only at the time of engine starting and decrease the fuel flow rate curing ordinary running operation, it is necessary to provide a pump of complicated construction in which the displacement is changeable and is increased only at the time of engine starting. In the case of adopting a high pressure fuel pump driven by a motor, although the fuel flow rate can be increased from the time of engine starting by rotating the pump at a high speed, independently of engine rotation, it causes a significant time delay to increase the speed of the pump to the necessary speed if a small motor used, since a high pressure is applied to the pump, and the load of the motor becomes large.

Therefore, it has been difficult to increase the pressure of fuel in a short period of time, independently of the method employed for driving the high pressure fuel pump, in a conventional fuel feeding apparatus not having an auxiliary pump for engine starting.

On the other hand, in the above-mentioned fuel feeding apparatus according to the present invention, when the low pressure fuel feed pump 2 starts, the fuel at a low pressure of P1, which is discharged into the low pressure fuel pipe 41 via the low pressure fuel pipe joint 43 and flows into the large diameter cylinder 8*c*, presses and moves the large diameter piston 8*a*. Further, the large diameter piston 8*a* moves the small diameter piston 8*b* in the small diameter cylinder 8*d*, increases the pressure of fuel in the small diameter cylinder 8*d* and feeds the fuel of the increased pressure to the high pressure fuel pipe 42 via the high pressure fuel pipe joint 44. The small diameter piston 8*b* can increase the injection pressure Pi of fuel in the high pressure fuel pipe 44 to a predetermined pressure by pressurizing fuel in the small diameter cylinder 8*d*, without operating the high pressure fuel pump 3. In the above-mentioned fuel pressurizing process, it is necessary to prevent the fuel discharged from the small diameter cylinder 8*d* in the intensifier 8 from reversely flowing in the direction toward the low pressure fuel feed pump 2 via the inside of the high pressure fuel pump 3 and flowing out of the fuel pump 3. In the embodiment of the present invention, since the discharge check valves 36 are provided at the exits of flow paths of the high pressure fuel pump 3, the reverse flow in the fuel pump 3 or leakage flow out of the fuel pump 3 caused by highly pressurized fuel in the cylinder 8*d* can be prevented. For a high pressure fuel pump without any check valve, it is preferable to newly provide such check valves at the high pressure fuel pump.

Figure 2A:
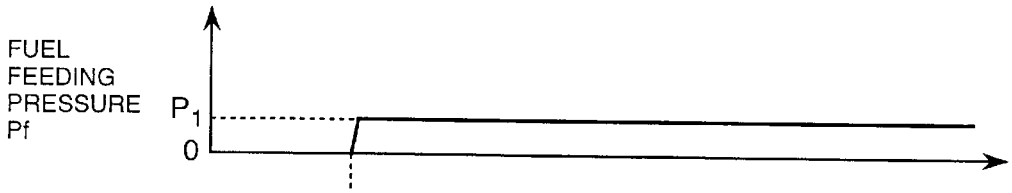
FIGS. 2A–2C are graph illustrations of operational characteristics, at the time of engine starting, of the fuel feeding apparatus according to the present invention, as compared with the operational characteristics of a conventional fuel feeding apparatus.
Figure 2B:
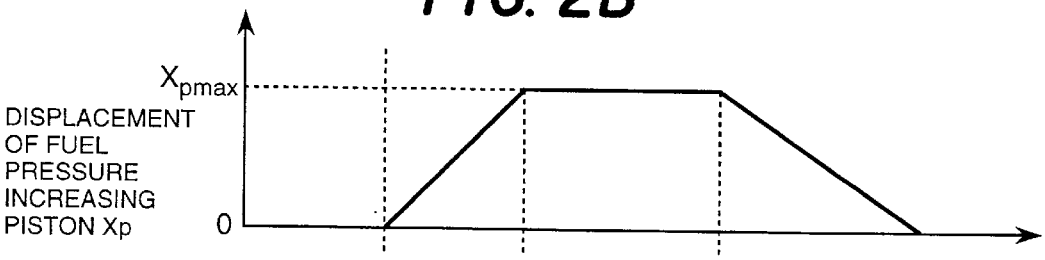
Figure 2C:
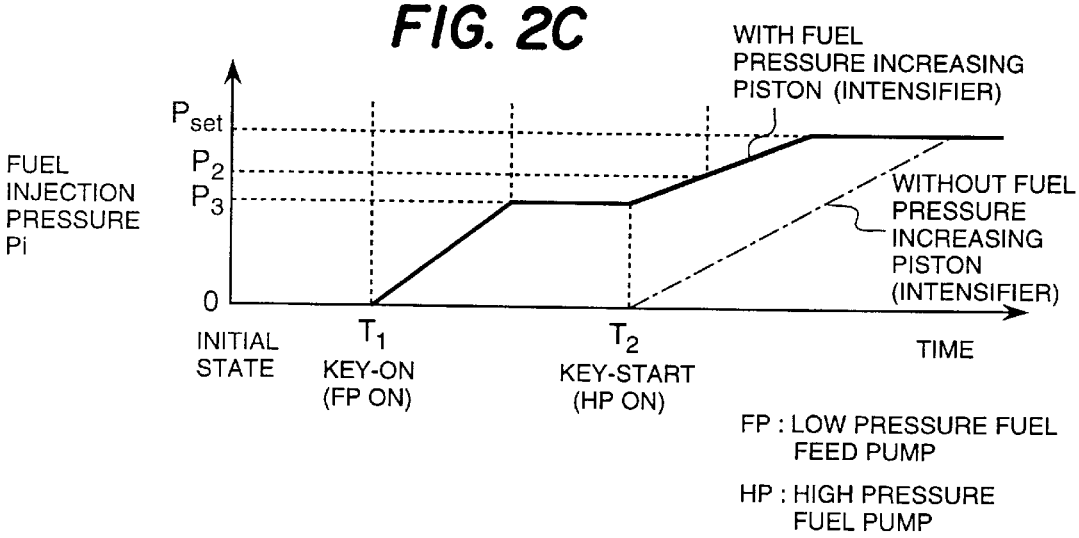

Referring to FIGS. 2A–2C, in the fuel feeding apparatus of the present invention, the relation between the pressure of fuel in the high pressure fuel pipe and the piston displacement Xp of the intensifier 8 at engine starting is shown. At engine starting, when the engine key is turned to the "ON" position, the low pressure fuel feed pump 2 starts and increases the fuel feeding pressure Pf to the preset low pressure value P1 (see FIG. 2A). The fuel feeding pressure Pf (the pressure of the low pressure fuel) is transferred to the large diameter cylinder 8*c* and presses the large diameter piston 8*a*. Further, the large diameter piston 8*a* begins to move (in the bottom direction of FIG. 1), and the small diameter piston 8*b* moves together with the movement of the large diameter piston 8*a*, whereby fuel in the small diameter cylinder 8*d* is pressurized, and the pressure Pi of fuel in the high pressure pipe 42 begins to increase. When the pistons 8*a* and 8*b* reach the position of the stroke end Xpmax, the increase of the pressure Pi of fuel injection stops at that time, and the pressure Pi remains at an intermediate pressure P3. The intermediate pressure P3 is determined by the fuel volume discharged from the intensifier 8, the fuel (gasoline) volume V2 contained in a system of the high pressure fuel pipe 42 and the bulk modulus K of the fuel (gasoline), the pressure P3 being expressed by the equation P3=V1×(K/V2). The intermediate pressure P3 can be maximally set by a possible maximum pressure increase value P2 (=P1×(A1/A2)). When the engine key is turned to the position "START" for engine starting after the pressure is increased by using the fuel feed pump 2, and the engine starter begins to rotate, the high pressure fuel pump 3 starts, and the pressure Pi of fuel in the high pressure fuel pipe 42 is further increased. Furthermore, when the pressure P1 attains the preset high pressure value Pset, the pressure Pi is adjusted so as to maintain the preset value Pset, using the high pressure regulator 5.

By setting the possible maximum pressure increase value P2 to a value lower than the preset high pressure value Pset, when the pressure increasing effect of the high pressure fuel pump begins to appear, and the pressure Pi of fuel in the high pressure fuel pipe 42 exceeds the possible maximum pressure increase P2, the force reversely pressing back on the small diameter piston 8*b* increases beyond the force being applied to the large diameter piston 8*a* and so the small diameter piston 8*b* is pushed upwardly. Consequently, the movement of the pistons 8*a* and 8*b* is reversed (in the upward direction of FIG. 1), so that the positions of the pistons 8*a* and 8*b* are returned back and automatically reset to the initial state (to their initial position).

It is important to note that the high pressure fuel in the high pressure fuel pipe 42 has already increased to the intermediate pressure value P3 at the time T2. Since the fuel pressure in the high pressure fuel pipe 42 remains zero at the time T2 in the conventional fuel feeding apparatus, the time necessary to increase the pressure of fuel to the preset pressure value Pset in the apparatus of the present invention is considerably reduced in comparison with the conventional fuel feeding apparatus, even if the discharge flow rate in the high pressure fuel pump is the same in both the conventional fuel feeding apparatus and the fuel feeding apparatus of the present invention.

If the possible maximum pressure increase value P2 of the intensifier 8 is set to a value higher than the preset high pressure value Pset, the pistons 8*a* and 8*b* will remain in position at the stroke end and will not be returned to their initial positions, since a force sufficient to reversely press and return the pistons 8*a* and 8*b* to their initial positions can not be generated during operations of the engine. In such case, it will be necessary for the pistons 8*a* and 8*b* to be pressed and returned to their initial positions after the low pressure fuel feed pump is stopped, during stopping of the engine, when the fuel feeding pressure Pf has been sufficiently decreased. However, if the pistons 8*a* and 8*b* are returned to their initial positions during stopping of the engine, as mentioned above, since the returning movement of the pistons causes a decrease in the pressure of fuel contained in the high pressure fuel pipe 42 at a time when the high pressure fuel feed pump has stopped, the high pressure of fuel in the high pressure fuel pipe 42 can not be maintained for the next engine starting. On the contrary, in the fuel feeding apparatus, as previously explained, the accomplished high pressure in the line 42 is not decreased, but is maintained, since the pistons 8*a* and 8*b* are returned to the initial positions while the high pressure fuel feed pump is still operating, which reduces the time necessary to increase the pressure of fuel contained in the high pressure fuel pipe 42 to the preset high pressure value and considerably improves the operational characteristics of engine starting.

In the above-explained example, according to the present invention, the fuel feeding apparatus has a structure such that the accomplished high pressure of fuel in the high pressure fuel pipe 42 is maintained the preset high pressure value Pset. However, the pressure of fuel in the high pressure fuel pipe 42 is very gradually decreased due to very small leakage of the fuel from the intensifier 8. In the fuel feeding apparatus of the present invention, since the positions of the pistons 8*a* and 8*b* in the intensifier 8 are returned to their initial positions every time engine starting is finished, the pistons 8*a* and 8*b* will move in a direction to increase the pressure Pi of fuel in the high pressure fuel pipe 42 and return the pressure Pi to the preset value Pset at every engine starling. In the case where the engine is restarted right after the engine stopped and the pressure Pi of fuel injection in the high pressure fuel pipe 42 is maintained at a level higher than the predetermined pressure P2, although the pistons 8*a* and 8*b* do not move, but stay at their initial positions, this does not cause any problem, since the pressure Pi of fuel in the high pressure fuel pipe 42 is kept at a high pressure state sufficient to effect fuel injection.

Figure 3A:
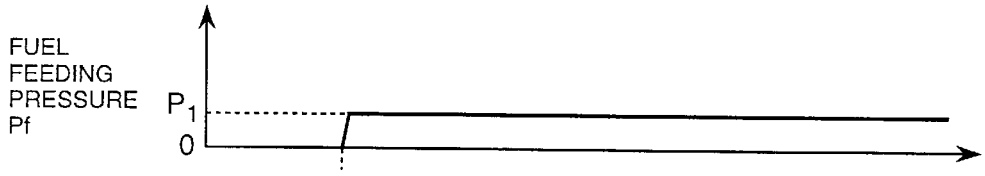
FIGS. 3A–3C are graph illustrations of operational characteristics at the time of engine starting, under operation conditions which are different from the conditions of the operation shown in FIG. 1, of the fuel feeding apparatus according to the present invention, as compared with the operational characteristics of a conventional fuel feeding apparatus.
Figure 3B:
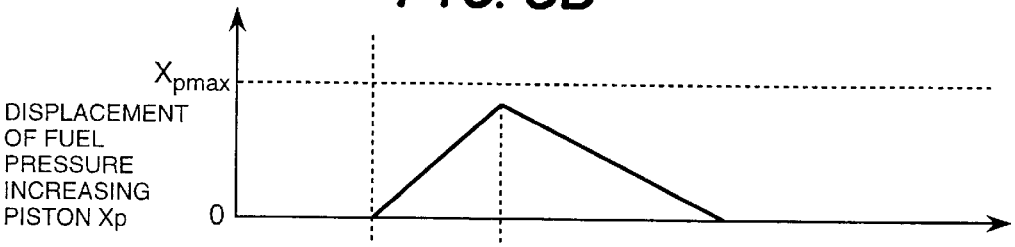

As to the operation time interval from the time T1 of turning the ignition key to the position "ON" to the time T2 of turning the ignition key to the position "START", there normally will be an individual difference depending on the operator driving the vehicle. The fuel pressure increase at the time of engine starting behaves as indicated in FIGS. 2A–2C, for operations providing a long operation time interval from the time T1 to the time T2, and as indicated in FIGS. 3A–3C, for operations providing only a short operation time interval from the time T1 to the time T2.

Figure 3C:
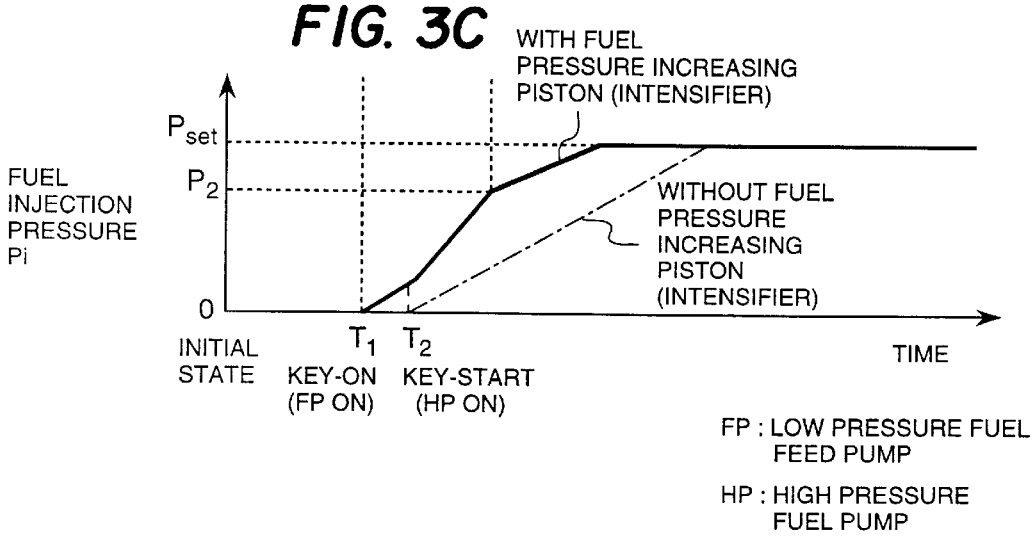

As to the behavior of the fuel pressure increase shown in FIGS. 3C, at the time T1, the low pressure fuel feed pump 2 starts, and the pistons 8*a* and 8*b* of the intensifier 8 begin to move, so that the pressure Pi of fuel in the high pressure fuel pipe 42 also begins to increase. If the ignition key is turned to the position "START" at the time T2 shortly after the time T1, and the high pressure fuel pump 3 starts, it is considered that the pressure Pi of fuel injection will rapidly increase since fuel is discharged by both the intensifier 8 and the high pressure fuel pump 3. However, since both the low pressure fuel feed pump 2 and the starter are driven by motors to which electricity is fed from the battery in the vehicle during the operation period, and the high pressure fuel pump 3 is driven together with the engine by the starter, the load on the battery rapidly increases and the output voltage of the battery largely decreases. Further, since a decrease in the output voltage causes a decrease in the rotational speed of the motor driving the fuel feed pump 2, decreasing of the fuel feed pressure Pf and the flow rate of fuel fed from the fuel tank 6, the time required for increasing the fuel pressure in the high pressure fuel pipe 42 to the preset value is consequently lengthened.

Figure 4A:
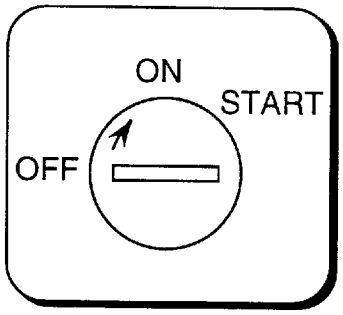
FIGS. 4A and 4B are diagrams of an ignition key switch and of a drive circuit for driving a motor for driving a low pressure fuel feed pump, and a starter for driving an engine at the time of engine starting, including a delay circuit.

In order to avoid the above-mentioned probably occurring problem at the time of engine starting in the fuel feeding apparatus of the present invention, it is desirable to provide enough time for the pistons 8*a* and 8*b* of the intensifier 8 to move to the stroke end within the interval from the time T1 of starting the low pressure fuel feed pump 2 to the time the high pressure fuel pump 3 starts to operate. In order to solve this problem, according to the present invention, a delay circuit 15 is provided between the ignition key switch 14 (see FIG. 4A) and the starter 17, as shown in FIG. 4B.

Figure 4B:
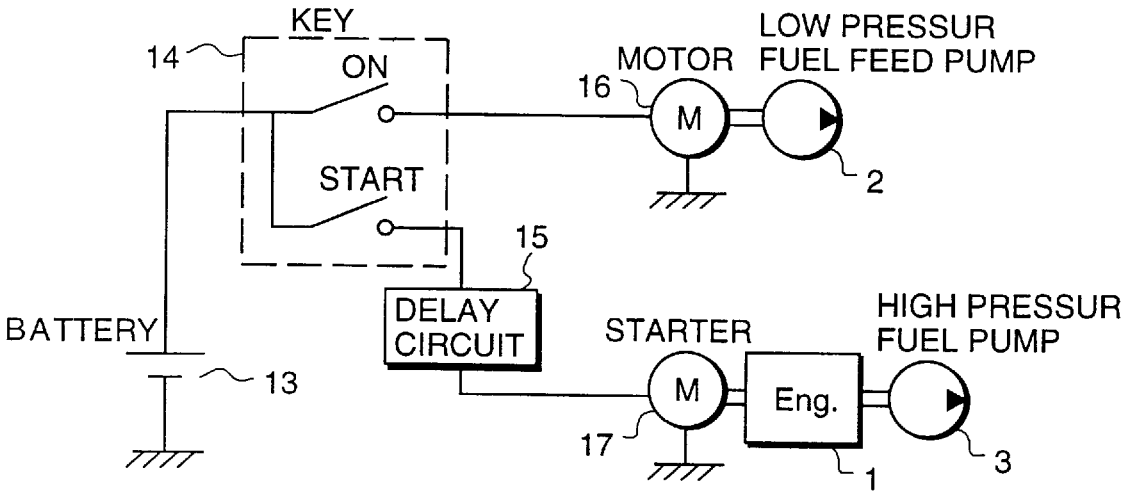
Figure 5A:
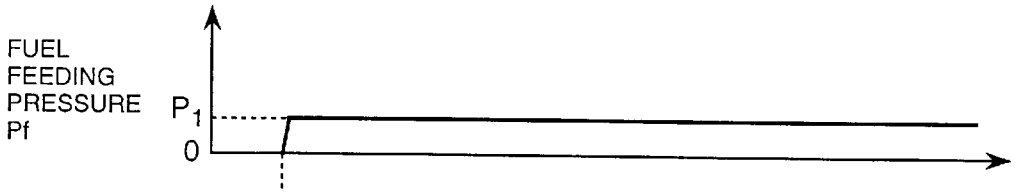
FIGS. 5A–5D are graph illustrations indicating operational characteristics at the time of engine starting, including operations of each injection valve, of the fuel feeding apparatus according to the present invention.
Figure 5B:
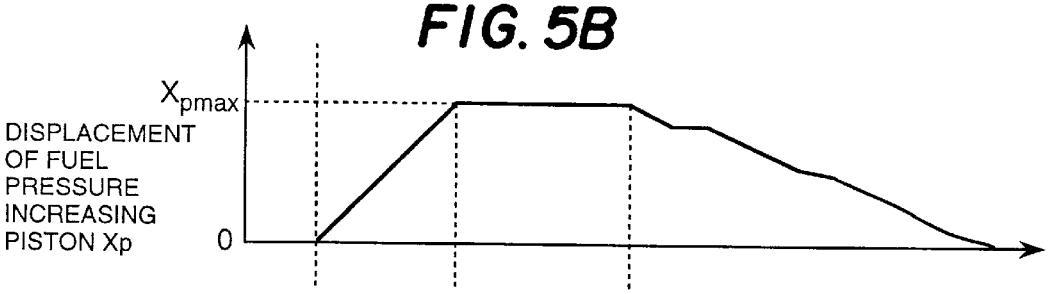
Figure 5C:
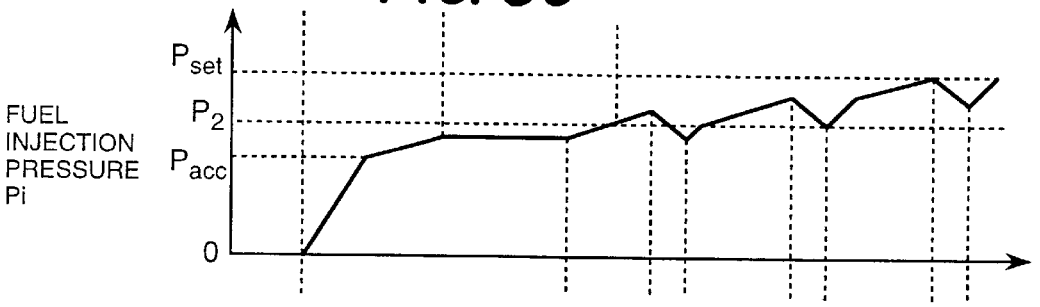
Figure 5D:
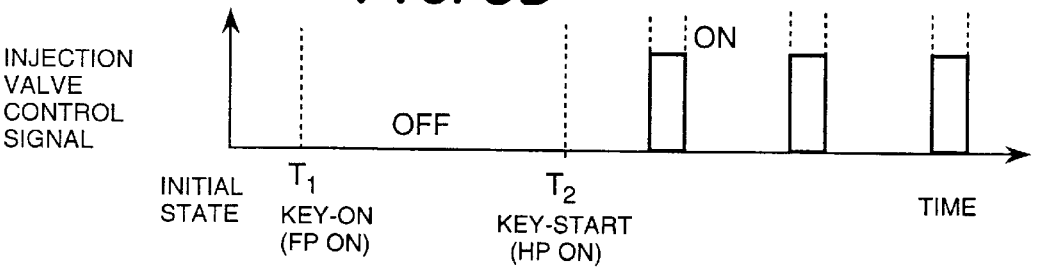

Referring to FIG. 4B, the high pressure fuel pump 3 is connected to the starter 17 via the internal combustion engine 1. The delay circuit 15 feeds a driving current after a preset delay time, when the engine key switch 14 is turned to the position "START" and current is input from the vehicle battery 13 to the delay circuit 15. Actually, the driving current supplied to the starter 17 does not actually flow through the engine key switch 14 and the delay circuit 15 as shown, but, as is conventional, such driving current is fed to the starter 17 from the battery 13 via an electromagnetic switch (not shown in a figure) controlled by the ignition key switch 14 and the delay circuit 15.

By providing the above-mentioned delay feature in the fuel feeding apparatus, even if the ignition key switch 14 is instantly turned from the position "ON" to the position "START", since it is possible to provide a sufficient time interval from the start of the low pressure fuel feed pump 2 to the start of the high pressure fuel pump 3, the function of the intensifier 8 is effectively utilized, and the operational characteristics of engine starting are improved.

Further, in the case where the high pressure fuel pump 3 is driven by a motor, the same effect can be gained by providing a similar delay circuit as that shown in FIG. 4 between the ignition key switch and the motor driving the high pressure fuel pump.

By means of the above-mentioned fuel feeding apparatus, it is possible to reduce the time required for increasing the pressure Pi of fuel in the high pressure fuel pipe 42 at the time of engine starting. However, if the amount of fuel discharged from the high pressure fuel pump 3 at the time of engine starting is not sufficient, large changes in the pressure Pi of fuel in the high pressure fuel pipe 42 will probably occur due to the fuel injection at the respective injection valves 7. To solve this problem, in the fuel feeding apparatus of the embodiment according to the present invention, as shown in FIG. 1, an accumulator 18 is connected to the high pressure fuel pipe 42 at the discharge side of the high pressure fuel pump 3 so that highly pressurized fuel is accumulated in the accumulator 18 before the respective injection valves 17 begin to inject pressurized fuel into the cylinders.

As seen in FIGS. 5A–5D, changes in the pressure Pi of fuel injection at the time of engine starting (see FIG. 5C), corresponding to the displacement Xp of the pistons of the intensifier 8 (see FIG. 5B), are shown in the case where the above-mentioned accumulator 18 is provided and effectively functions to dampen fluctuations in pressure in the fuel line 42. In the changes of the pressure Pi, it is assumed that both the fuel feed pressure Pf and the pressure Pi of fuel injection are 0 before engine starting.

When the low pressure fuel feed pump 2 starts and the fuel feed pressure Pf acts on the intensifier 8, the pistons 8*a* and 8*b* begin to move in the direction to increase the pressure of fuel in the small diameter cylinder 8*d*, and the pressure Pi of fuel in the high pressure fuel pipe also begins to increase. Further, the pressurized fuel is charged into the accumulator via the high pressure pipe 42 by setting the possible maximum pressure increase value P2 of the intensifier 8 to a level higher than the fuel accumulating start pressure value Pacc of the accumulator 18. Since the accumulation of the pressurized fuel starts from the time point at which the pressure Pi exceeds the fuel accumulating start pressure value Pacc, the rate of pressure increase of fuel becomes smaller. When the pistons 8*a* and 8*b* reach the stroke end Xpmax, the increase of the pressure Pi stops. Further, when the high pressure fuel pump 3 starts at the time T2, the accumulation of fuel in the accumulator 18 again proceeds and the pressure Pi also begins to increase again. After the accumulation of fuel by the intensifier 8 is finished, even if each injection valve starts to inject fuel into a cylinder, it is possible to supply the amount of the fuel injected from each injection valve from the accumulator 18 in which the highly pressurized fuel is accumulated. Therefore, the decrease of the pressure Pi at the time of fuel injection can be kept small, and the fuel injection can be performed while maintaining the pressure Pi high.

On the other hand, if the possible maximum pressure increase value of the intensifier 8 is set lower than the fuel accumulating start pressure value Pacc of the accumulator 18, the accumulation of fuel in the accumulator 18 begins after the time point at which the pressure Pi of fuel injection exceeds the fuel accumulating start pressure value Pacc. If the fuel injection starts almost at the same time as the accumulation starts, since a sufficient amount of fuel is not accumulated in the accumulator 18 yet, the fuel accumulated in the accumulator will be thoroughly exhausted for a short time. Therefore, the decrease in the pressure Pi will be large at the time of fuel injection, and so it becomes difficult to perform fuel injection while keeping the pressure Pi high. Thus, in accordance with the present invention, the possible maximum pressure increase value P2 of the intensifier 8 should be set higher than the fuel accumulating start pressure value Pacc of the accumulator 18.

Figure 6:
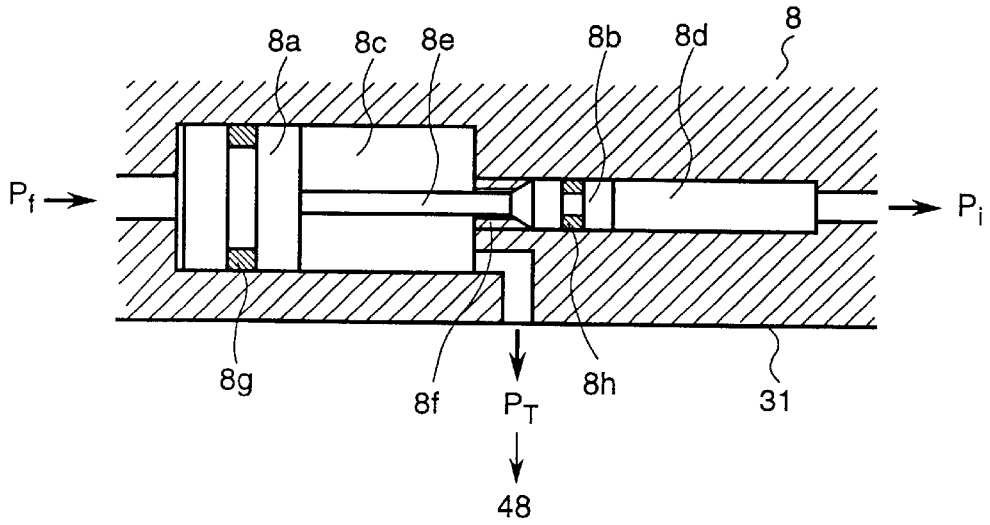
FIG. 6 is a longitudinal sectional view of an intensifier of the fuel feeding apparatus according to the present invention.

In the following, a feature of the present invention will be explained, in which the performance of the intensifier 8, for maintaining the fuel at a high pressure after the engine starting is finished, is improved. FIG. 6 shows a structure of an example of an improved intensifier 8 in the fuel feeding apparatus of the present invention. The improved intensifier 8 is composed of a casing 31 (rear body) in which two cylindrical cavities (the large diameter cylinder 8*c* and the small diameter cylinder 8*d*) having different diameters are formed along the same longitudinal axis, the large diameter piston 8*a* and the small diameter piston 8*b* installed in the large diameter cylinder 8*c* and the small diameter cylinder 8*d*, respectively, so as to be movable in the longitudinal axis direction, a rod 8*e* connecting the large diameter piston 8*a* to the small diameter piston 8*b*, a valve seat 8*f* provide between the large diameter piston 8*a* and the small diameter piston 8*b* and through which the rod 8*e* can move in the longitudinal axis direction, and seals 8*g* and 8*h* mounted at the grooves formed at circumferential parts of the large diameter piston 8*a* and the small diameter piston 8*b*, respectively.

In FIG. 6, the fuel supplied at a low pressure Pf is fed to a space formed at the left side of the large diameter piston 8*a* in the large diameter cylinder 8*c* and presses against the large diameter piston 8*a*, so that the large diameter piston 8*a* moves the small diameter piston 8*b*, connected to the large diameter piston 8*a* via the rod 8*e*, toward the right as seen in the figure. A space formed at the right side of the small diameter piston 8*b* in the small diameter cylinder 8*d* communicates with the high pressure fuel pipe 42, and the pressure Pi is increased by this movement of the small diameter piston 8*a* to the right, thereby compressing and discharging fuel in the space at the right side of the piston 8*b*. Further, the space at the right side of the large diameter piston 8*a* in the large diameter cylinder 8*c* communicates with a pipe 48 returning to the fuel tank 6, from which the very small amount of fuel leaking through parts at the seals 8*g* and 8*g* is exhausted to the fuel tank 6.

If the pressurized high pressure of fuel during engine operation is maintained after the engine stopped, restarting the engine becomes very easy. Therefore, it is required to suppress fuel leakage as much as possible during engine stopping, from the injection valves 7, the high pressure fuel pump 3, the high pressure regulator 5, etc. Preventing fuel leakage is also required for the intensifier 8. A small fuel leakage in the intensifier 8 is caused by fuel leaking through the seal 8*h* to the space formed at the left side of the small diameter piston 8*b*. It is difficult to prevent the small fuel leakage in the intensifier 8 using only the seal 8*h*. Although it may be considered to provide a check valve between the small diameter cylinder 8*d* and the high pressure fuel pipe 42, this is impossible due to the need to return the pistons 8*a* and 8*b* to their initial positions (reset state) by utilizing the pressure of fuel highly pressurized by the high pressure fuel pump 3, in order to prepare the conditions of the fuel feeding apparatus for the next easy engine starting.

In the intensifier 8 of the fuel feeding apparatus according to the present invention, to make the prevention of the fuel leakage through the part of the seal 8*h* and the function of resetting the state of the intensifier 8 compatible with each other, a tapered face is formed at the left side (back) part of the small diameter piston 8*b*, and this tapered face is used as part of a check valve for preventing fuel leakage, by seating the tapered face as a poppet valve against the valve seat 8*f* when the pistons 8*a* and 8*b* are returned to their initial positions due to the high back pressure maintained in the line 42. When the engine starts and fuel in the high pressure fuel pipe 42 is highly pressurized, the small diameter piston 8*b* is pressed back and returned to its initial position (reset state) by the high pressure Pi of fuel injection, and the tapered part of the small diameter piston 8*b* is tightly seated in the valve seat 8*f*. Therefore, fuel leakage from the intensifier 8 is almost completely prevented in the reset state of the intensifier 8. Further, it becomes possible to make the prevention of the fuel leakage from the intensifier 8 and the function of reletting the state of the intensifier 8 compatible with each other.

It is not always necessary to integrate the large diameter piston 8*a* and the small diameter 8*b* into one body as mentioned in the above-mentioned embodiment. It is possible to provide the large diameter piston 8*a* and the small diameter 8*b* as two separated bodies, whereby the allowable error in axis fitting of the two pistons 8*a* and 8*b* can be made larger.

A method of effecting disappearance of vapor bubbles generated in the fuel now will be explained. Vapor bubbles are generated in the fuel when fuel is heated to a high temperature by the engine, and the generated bubbles degrade the operational performance of the engine, since the vapor bubbles choke the flow of fuel in the high pressure fuel pipe 42. However, if the pressure of the fuel in which the vapor bubbles are generated is more highly pressurized, the vapor bubbles again dissolve into the fuel.

As already described, the fuel feeding apparatus of the present invention maintains the pressure of fuel in the high pressure fuel pipe 42 high also during the time the engine is stopped, and the apparatus can increase the pressure of fuel in the high pressure fuel pipe 42 before starting the high pressure fuel pump 3 to compensate for pressure loss. Therefore, the fuel feeding apparatus of the present invention has an advantage in that it is capable of suppressing generation of vapor bubbles in the high pressure fuel pipe and of dissolving the vapor bubbles by increasing the pressure of fuel in an early stage after engine starting, even if vapor bubbles are generated.

In the fuel feeding apparatus of the present invention, by making use of the above-mentioned advantage, it is possible to design the fuel feeding apparatus so that the length of the high pressure fuel pipe 42 can be shortened without a complicated and somehow unsafe arrangement of the components which make up the fuel feeding apparatus.

Figure 7:
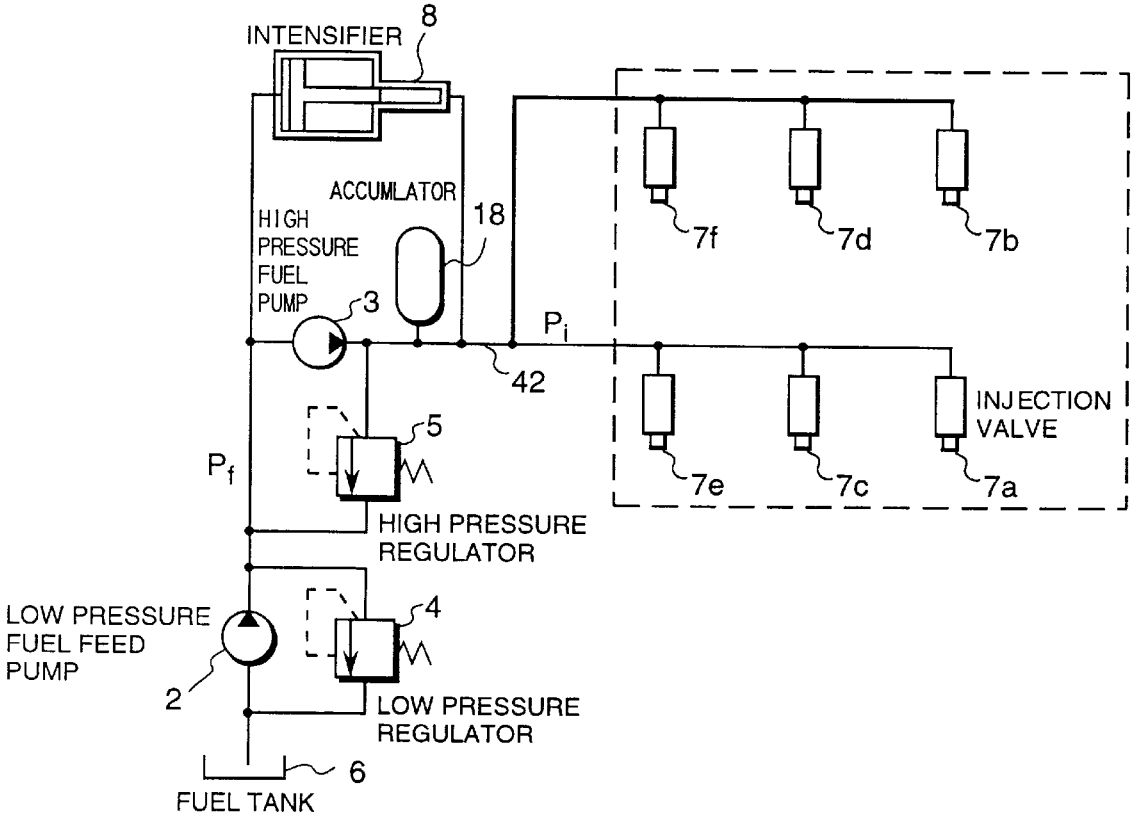
FIG. 7 is a fuel system diagram of the fuel feeding apparatus of the present invention, which is applied to an internal combustion engine of the V-type having 6 cylinders.

The fuel feeding apparatus shown in FIG. 7, according to the present invention, is designed so that, after the pressure of fuel highly pressurized and discharged from the high pressure fuel pump 3 is first adjusted by the pressure regulator 5 so as to maintain a preset high pressure value, the fuel is fed to the injection valves 7*a*–7*f* via the high pressure fuel pipe 42. Further, in the above-mentioned fuel feeding apparatus, the high pressure fuel pipe 42 is branched into two shortened pipes downstream of the accumulator 18. While the high pressure fuel pipe 42 is branched into the two shortened pipes in this way, it is no longer necessary to remove vapor bubbles generated in the fuel in the high pressure fuel pipes by circulating the fuel in the fuel pipes and exhausting the vapor bubbles from a high pressure regulator installed at the end parts of the high pressure fuel pipes, in accordance with the bubble removing method which has been adopted heretofore in a conventional fuel feeding apparatuses. Therefore, by adopting the present invention, it is possible to form the benched pipes of the high pressure fuel pipe 42 of the fuel feeding apparatus so as to have respective closed ends, and further to install the high pressure regulator 5 near the high pressure fuel pump, which can improve the safety and simplify the composition of the fuel feeding apparatus.

The fuel feeding apparatus of the present invention can be applied to not only a V type six-cylinder internal combustion engine, but also to any other type of internal combustion engine.

Figure 8:
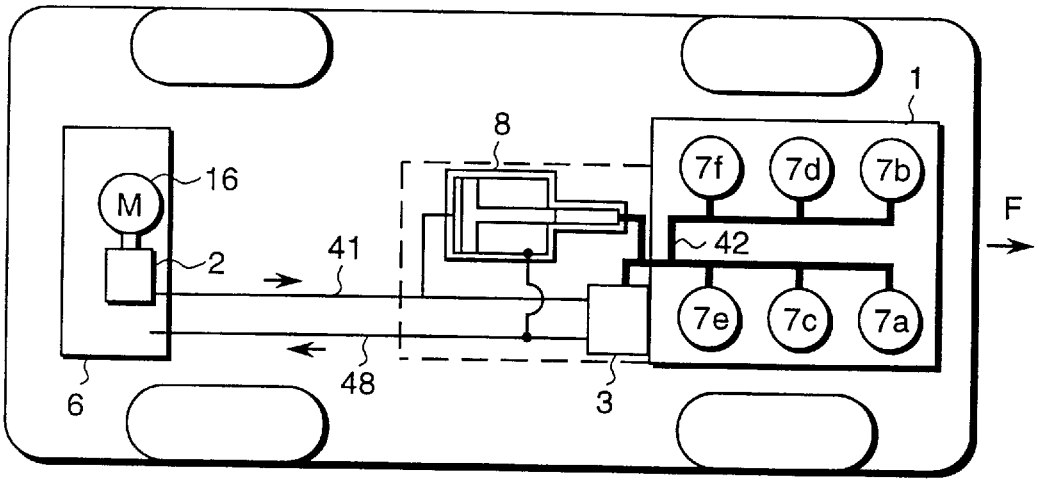
FIG. 8 is a diagrammatic plan view showing a typical component arrangement in a vehicle carrying the fuel feeding apparatus of the present invention.

FIG. 8 shows a typical plan view of a vehicle in which the fuel apparatus of the present invention is loaded. In the embodiment, the low pressure fuel feed pump 2 is driven by the motor 16, and the high pressure fuel pump 3 is driven by using the rotational force of the internal combustion engine 1 (engine block). In a front engine type vehicle, to avoid thermal influences from the internal combustion engine 1, the fuel tank 6 is usually provided at the back part of a vehicle body. The low pressure fuel feed pump 2 is installed in the vicinity of the fuel tank, or in the fuel tank 6, being immersed in the fuel. By means of the low pressure fuel feed pump 2, the fuel in the fuel tank 6 is drawn up and transferred to the engine compartment in the front part of the vehicle body via the low pressure fuel pipe 41.

In the fuel piping system of the vehicle, the high pressure pipe 42 to which a high pressure is applied, is shown by thick lines in the figure. It is desirable to gather components and pipes to which the high pressure is applied in one place, which makes it easier to take measures for the safety of the engine. Further, it is preferable to form the high pressure fuel pipe 42 of pipes having a small inner volume. Furthermore, it is also desirable to make the length of the high pressure fuel pipe 42 as short as possible, in order to increase the characteristic frequency of the fuel column in the high pressure fuel pipe 42.

Therefore, the intensifier 8 is to be arranged near the high pressure fuel pump 3. In the embodiment, the intensifier 8 and the high pressure fuel pump 3 is integrated into one body, as shown in FIG. 1, and is mounted on the engine block 1 in the engine compartment. Further, the high pressure fuel pipe 42 is branched into two pipes, each of the two pipes being arranged along a respective bank of the V-6 type engine block 1 and having a closed end. The high pressure fuel is distributed to two groups of injection valves 7*a*–7*f* from the respective branched pipes.

An illustration of the low and high pressure regulators 4 and 5 and the accumulator 18 has been omitted in FIG. 8.

The vehicle 50, in which the fuel feeding apparatus of the present invention is loaded, has the advantages of providing an engine having excellent operational characteristics of engine starting and a simple and safe composition of a high pressure fuel piping system, and especially, the vehicle 50 can be operated with very low level noise, the operations of the engine being realized by preventing generation of the resonant oscillation of a fuel column in the high pressure fuel pipe 42, while executing accurate fuel injection control.

In order to prevent the generation of vapor bubbles in the high pressure fuel pipe system produced by heating of the fuel by the internal combustion engine 1, it is also effective to drive the high pressure fuel pump 3 with a motor and separate the high pressure fuel pump 3 from the engine block 1, or install the high pressure fuel pump 3 at a place in the engine compartment where the temperature does not increase to a high level during engine operation.

In the intensifier 80*f* the above-mentioned embodiments, the small diameter piston 8*b*, for increasing the pressure of fuel in the high pressure fuel pipe 42, is driven by the large diameter piston 8*a* pressed and moved by the low pressure fuel fed from the low pressure fuel feed pump 2. However, a motor can be used in place of the large diameter piston 8*a*. In the case of using a motor for driving the small diameter piston 8*b*, the motor is started when the ignition key is turned to the position "ON", and presses and moves the small diameter piston 8*b* to increase the fuel in the high pressure fuel pipe, and the small diameter piston 8*b* then is returned to the initial position by reversely rotating the motor after the engine starting is finished.

What is claimed is:

1. A fuel feeding apparatus for an internal combustion engine, comprising:

a low pressure fuel feed pump for pressurizing and transferring fuel from a fuel tank;

a high pressure fuel pump, whose operation is started subsequently to that of said low pressure fuel feed pump at the time of engine starting, for more highly pressurizing said fuel transferred by said low pressure fuel feed pumps, in comparison with the pressure of said transferred fuel, and for feeding said more highly pressurized fuel to a high pressure fuel pipe;

pressure increasing means, provided in addition to said high pressure fuel pump, for increasing the pressure of fuel in said high pressure fuel pipe at the time of initiation of engine starting and before said high pressure fuel pump is started;

means for maintaining a preset high pressure value to be attained by said high pressure fuel pump in said high pressure fuel pipe after said engine is stopped subsequently to starting and for returning an operational state of said pressure increasing means to an initial state, which it was in before engine starting was initiated, when said high pressure fuel pump is started; and a plurality of injection valves, connected to said high pressure fuel pipe, for injecting said fuel, which is highly pressurized to said preset high pressure value and is contained in said high pressure fuel pipe, into cylinders of said internal combustion engine.

2. A fuel feeding apparatus according to claim 1, wherein said pressure increasing means includes a pressure increasing device, comprising a first piston which is provided in a first cylinder and is moved in response to pressure of said fuel supplied to said first cylinder by said low pressure fuel feed pump, and a second piston which is provided in a second cylinder having a diameter smaller than the diameter of said first piston and which is connected to said first piston and moved together with said first piston, for pressurizing fuel in said second cylinders, which communicates with said high pressure fuel pipe.

3. A fuel feeding apparatus according to claim 2, wherein said preset high pressure value attained by said high pressure fuel pump is maintained at said high pressure fuel pipe after the engine is stopped subsequently to starting, and said first and second pistons are automatically returned to initial positions which said first and second pistons occupied before engine starting was initiated, respectively, by setting the relative sizes of said first and second cylinders, including said respective pistons, so that a possible maximum pressure to which the fuel in said high pressure fuel pipe is increased by said pistons is lower than said preset high pressure value to be attained by said high pressure fuel pump.

4. A fuel feeding apparatus according to claim 2, wherein an accumulator is connected to said high pressure fuel pipe, and a preset accumulation start pressure value is set to be higher than a value of said possible maximum pressure to which the fuel in said high pressure fuel pipe is increased by said pressure increasing means, so that fuel accumulation into said accumulator is started when the pressure of fuel in said high pressure fuel pipe exceeds said preset accumulator start pressure.

5. A fuel feeding apparatus according to one of claims 1–4, wherein electrical energy feed delay means for delaying feed of electrical energy to a driving means for driving said high pressure fuel pump at the time of engine starting is provided between said driving means and an electrical energy feed means.

6. A fuel feeding apparatus according to one of claims 2–4, wherein said first piston is connected to said second piston with a rod, a valve seat through which said rod moves is provided between said first piston and said second piston, and a valve part to be seated in said valve seat is provided between said valve seat and said second piston, said valve part and said valve seat being fitted to each other and forming a check valve mechanism operable in said initial positions of said first and second pistons.

7. A fuel feeding apparatus according to one of claims 1–4, wherein said high pressure fuel pump and said pressure increasing means are integrated into one body structure.

8. A fuel feeding apparatus according to claim 7, wherein each of said high pressure fuel pump and said pressure increasing means has a fuel flow path communicating with a fuel flow path of a low pressure fuel pipe joint connecting a low pressure fuel pipe through which fuel is transferred from said low pressure fuel feed pump, to said one body structure, and another fuel flow path communicating with a fuel flow path of a high pressure fuel pipe joint connecting said high pressure fuel pipe to said one body structure.

9. A fuel feeding apparatus according to one of claims 1–3, wherein said high pressure fuel pipe has a closed end structure to reduce the length thereof, and a high pressure regulating means for adjusting the pressure of fuel in said high pressure fuel pipe so as to keep said preset high pressure value is provided between said high pressure fuel pump and said injection valves, whereby generation of vapor bubbles in fuel flowing in said high pressure fuel pipe is prevented, and a resonance oscillation of a liquid fuel column in said high pressure fuel pipe is also prevented by shortening the length of said high pressure fuel pipe.

10. A fuel feeding apparatus according to claim 9, wherein an accumulator is connected to said high pressure pipe.

11. A vehicle, comprising:

a fuel tank provided at a back part of a body of said vehicle;

a low pressure fuel feed pump disposed in the vicinity of or in said fuel tank;

an internal combustion engine provided at a front part of said body, including injection valves for injecting fuel into cylinders of said engine;

a high pressure fuel pump provided in the vicinity of or at said internal combustion engine, for more highly pressurizing said fuel fed from said fuel tank by said low pressure fuel feed pump through a low pressure fuel pipe, in comparison with the pressure of said fuel fed to said high pressure fuel pump;

a high pressure fuel pipe from which said fuel highly pressurized by said high pressure fuel pump is fed to each of said injection valves; and pressure increasing means, provided in addition to said high pressure fuel pump, for increasing the pressure of fuel in said high pressure fuel pipe at the time of initiation of engine starting and before said high pressure fuel pump is started, wherein a preset high pressure value, attained by said high pressure fuel pump during operation thereof, is maintained at said high pressure fuel pipe after said engine is stopped subsequently to starting.

12. A fuel feeding apparatus according to claim 11, wherein said high pressure fuel pipe has a closed end structure.

13. A fuel feeding apparatus according to claim 11 or claim 12, wherein each of said high pressure fuel pump and said pressure increasing means has a fuel flow path communicating with a fuel flow path of a low pressure fuel pipe joint connecting a low pressure fuel pipe through which fuel is transferred from said low pressure fuel feed pump, to said high pressure fuel pump, and another fuel flow path communicating with a fuel flow path of a high pressure fuel pipe joint connecting said high pressure fuel pipe to said high pressure fuel pump.

14. A vehicle according to claim 11, wherein said pressure increasing means comprises a fuel pressurization piston system for pressurizing fuel in said high pressure fuel pipe, said piston system being driven and moved in a direction to increase the pressure of fuel in said high pressure fuel pipe, by the pressure of said fuel fed from said low pressure fuel feed pump, at the time of engine starting, and being reversely driven and returned to an initial position of said piston system by the pressure of said fuel highly pressurized by said high pressure fuel pump, when the pressure of said highly pressurized fuel in said high pressure pipe exceeds a pressure value preset to said piston system.

* * * * *